US010842265B2

(12) United States Patent
Buszka et al.

(10) Patent No.: US 10,842,265 B2
(45) Date of Patent: Nov. 24, 2020

(54) BEVERAGE HOLDER

(71) Applicant: WHIRLPOOL CORPORATION, Benton Harbor, MI (US)

(72) Inventors: Timothy J. Buszka, Douglas, MI (US); Kamil El Sayed, Wroclaw (PL); Sheila P. Stafford, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/159,870

(22) Filed: Oct. 15, 2018

(65) Prior Publication Data

US 2020/0113327 A1 Apr. 16, 2020

(51) Int. Cl.
*A47B 73/00* (2006.01)
*F25D 31/00* (2006.01)

(52) U.S. Cl.
CPC ..... *A47B 73/004* (2013.01); *A47B 73/008* (2013.01); *F25D 31/007* (2013.01); *F25D 2331/803* (2013.01); *F25D 2331/809* (2013.01); *F25D 2500/02* (2013.01)

(58) Field of Classification Search
CPC ... A47B 73/004; A47B 73/008; F25D 31/007; F25D 2331/809; F25D 2500/02; F25D 2331/803
See application file for complete search history.

(56) References Cited

U.S. PATENT DOCUMENTS 2,327,379 A 8/1943 Thomas
2,512,502 A 6/1950 Paschell
2,620,691 A * 12/1952 Gould ..... B67B 7/16 108/28
2,919,814 A * 1/1960 Berkowitz ..... A47F 7/281 211/74
2,921,690 A 1/1960 Smith et al.
2,954,876 A 10/1960 Mathews
3,491,893 A * 1/1970 Morris ..... A47B 13/16 211/162
3,524,671 A * 8/1970 Akeireb ..... B65D 71/48 294/87.2
4,037,766 A * 7/1977 Iacono ..... B65D 71/50 206/160
D267,914 S * 2/1983 Lin ..... D6/513
4,700,849 A * 10/1987 Wagner ..... A47B 73/00 211/113
4,905,949 A 3/1990 Cosgrove
4,909,401 A * 3/1990 McConnell ..... A47J 47/16 211/41.8

(Continued)

FOREIGN PATENT DOCUMENTS

DE 2657611 A1 6/1978
DE 202006014650 1/2007

(Continued)

*Primary Examiner* — Ko H Chan

(74) *Attorney, Agent, or Firm* — Price Heneveld LLP

(57) ABSTRACT

A beverage holder includes a platform with a slot disposed therethrough. First and second L-shaped rails extend downwardly from an underside of the platform on either side of the slot. The first and second rails are configured to retain cans, at upper portions of the cans, in a sliding manner therebetween. The slot is centrally positioned between the first and second L-shaped rails and configured to suspend bottle top portions therefrom.

12 Claims, 16 Drawing Sheets

(56) References Cited

U.S. PATENT DOCUMENTS 5,071,002 A * 12/1991 Bradley ..... A47G 23/0216 206/217
5,358,128 A 10/1994 Belokin et al.
5,586,665 A * 12/1996 Brousseau ..... A47F 7/285 193/12
5,755,341 A 5/1998 Spamer
5,971,167 A * 10/1999 Finbow ..... A47G 23/0208 206/426
6,283,566 B1 * 9/2001 Doces ..... A47B 81/04 211/71.01
6,508,356 B2 * 1/2003 Martins ..... B65D 71/50 206/147
6,631,812 B2 * 10/2003 Ruiz ..... A47G 23/0208 211/113
7,017,759 B1 3/2006 Friend
D587,031 S * 2/2009 Pourounidis ..... A47J 47/005 D7/698
7,562,785 B2 * 7/2009 Meissen ..... B65D 11/1866 220/4.28
7,802,697 B2 9/2010 Martin
7,950,756 B2 * 5/2011 Collins ..... F25D 25/02 312/248
D642,837 S * 8/2011 Gray ..... A47B 81/04 D6/513
8,016,132 B2 * 9/2011 LaRiviere ..... A47G 23/0208 211/85.29
9,217,602 B2 * 12/2015 Lee ..... F25D 25/02
9,320,368 B2 * 4/2016 Marotti ..... A47B 73/004
9,751,061 B2 * 9/2017 Bergamini ..... B01F 13/1055
2007/0228242 A1 10/2007 Martin
2014/0284440 A1 9/2014 Marotti et al.

FOREIGN PATENT DOCUMENTS

KR 20090121029 A1 11/2009
WO 2006057017 A1 6/2006
WO 2006126180 A1 11/2006

* cited by examiner

BEVERAGE HOLDER

BACKGROUND

The present device generally relates to a beverage holder, and more specifically, to a beverage holder for bottles and cans that mounts to a surface of a refrigerator.

SUMMARY

In at least another aspect, a beverage holder includes a body portion having an interior cavity and a platform. A slot is disposed through the platform and opens into the interior cavity. The slot includes a perimeter edge defining an enlarged first portion and a narrowed second portion. The narrowed second portion is narrower than the enlarged first portion. A first rail includes first and second portions. The first portion of the first rail downwardly extends from an underside of the platform of the body portion. A second rail includes first and second portions. The first portion of the second rail downwardly extends from the underside of the platform of the body portion. The second portions of the first and second rails inwardly extend towards one another.

In at least another aspect, a beverage holder includes a platform having a slot disposed therethrough. The slot includes first and second sides. A first rail includes first and second portions. The first portion of the first rail downwardly extends from an underside of the platform at a position disposed outwardly from the first side of the slot. A second rail includes first and second portions. The first portion of the second rail downwardly extends from the underside of the platform at a position disposed outwardly from the second side of the slot. The second portion of the first rail inwardly extends towards the slot, and the second portion of the second rail inwardly extends towards the slot.

In at least another aspect, a beverage holder includes a platform having opposed first and second L-shaped rails spaced-apart from one another and extending downwardly from the platform. A slot is disposed through the platform and is positioned between the first and second L-shaped rails.

These and other features, advantages, and objects of the present device will be further understood and appreciated by those skilled in the art upon studying the following specification, claims, and appended drawings.

DETAILED DESCRIPTION OF EMBODIMENTS

Figure 1:
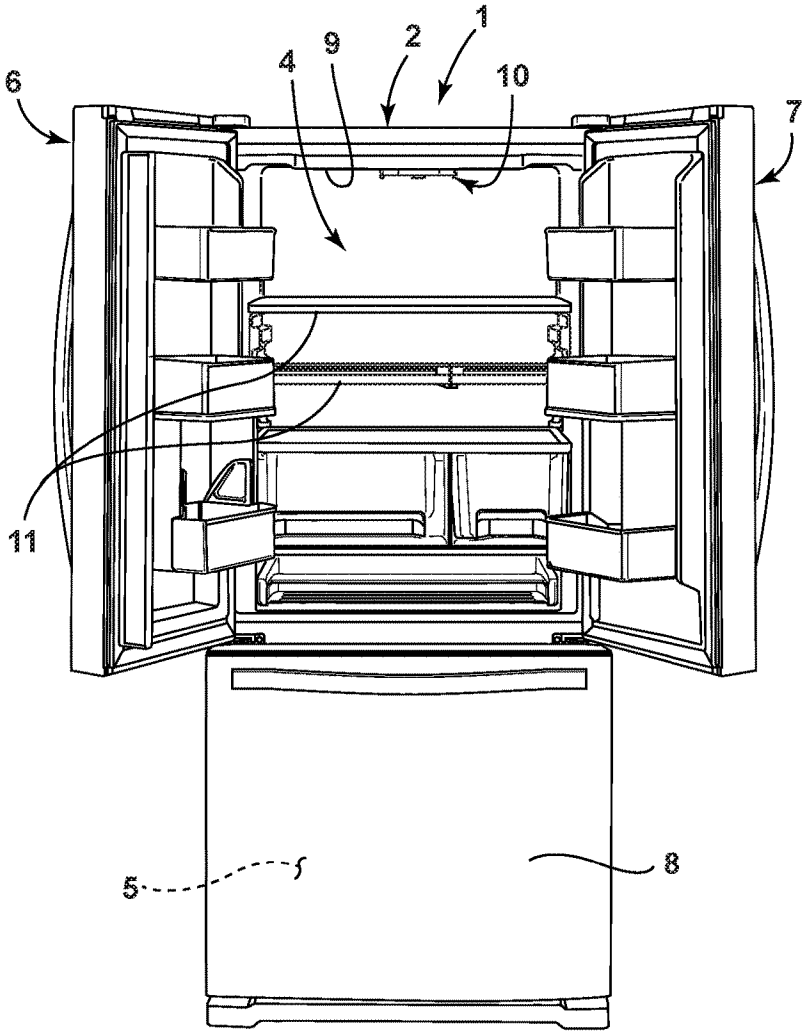
FIG. 1 is a front elevational view of a refrigerator with a refrigerator compartment having a beverage holder of the present concept mounted therein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, a refrigerator 1 is shown having a cabinet 2 which may be a vacuum insulated cabinet structure. The cabinet 2 includes a refrigerator compartment 4 and a freezer compartment 5. Doors 6 and 7 are provided to selectively provide access to the refrigerator compartment 4, while a drawer 8 is used to selectively provide access to the freezer compartment 5. The configuration of the refrigerator 1 shown in FIG. 1 is a French door style refrigerator with a lower freezer compartment 5. This configuration is exemplary only and the present concept is contemplated for use in all refrigerator styles including, but not limited to, side-by-side refrigerators, whole refrigerator and freezers, and refrigerators with upper freezer compartments.

As further shown in FIG. 1, the refrigerator compartment 4 includes an upper surface 9 to which a beverage holder 10 of the present concept is mounted. In the embodiment shown in FIG. 1, the beverage holder 10 is centrally mounted to the upper surface 9 of the refrigerator compartment 4, but could be mounted to any suitable portion of the refrigerator 1, including the underside of a storage shelf 11. By mounting the beverage holder 10 to the upper surface 9 of the refrigerator compartment 4, the beverage holder 10 makes use of space within the refrigerator compartment 4 that often goes unutilized.

Figure 2:
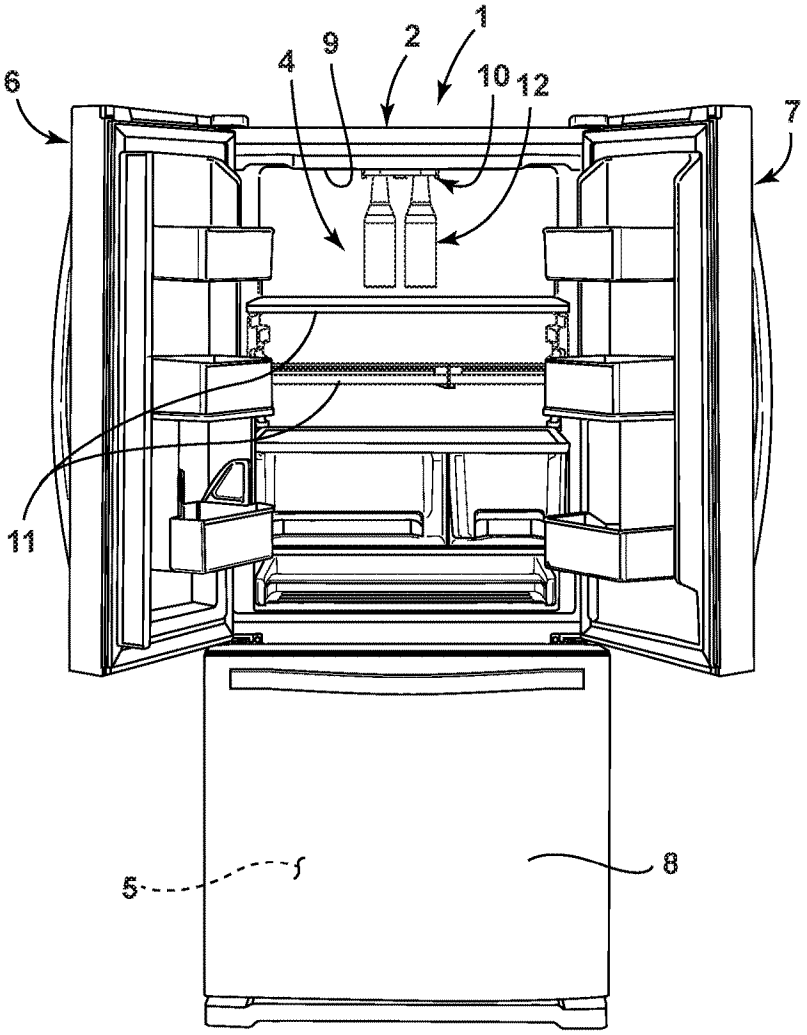
FIG. 2 is a front elevational view of the refrigerator and beverage holder of FIG. 1 showing bottles received in the beverage holder.

Referring now to FIG. 2, bottles 12 are shown mounted to the beverage holder 10 within the refrigerator compartment 4. The bottles 12 are shown as being suspended from the beverage holder 10, as further described below. By mounting the beverage holder 10 to the upper surface 9 of the refrigerator compartment 4, the beverage holder 10 provides improved visibility and accessibility for the items stored therein.

Figure 3:
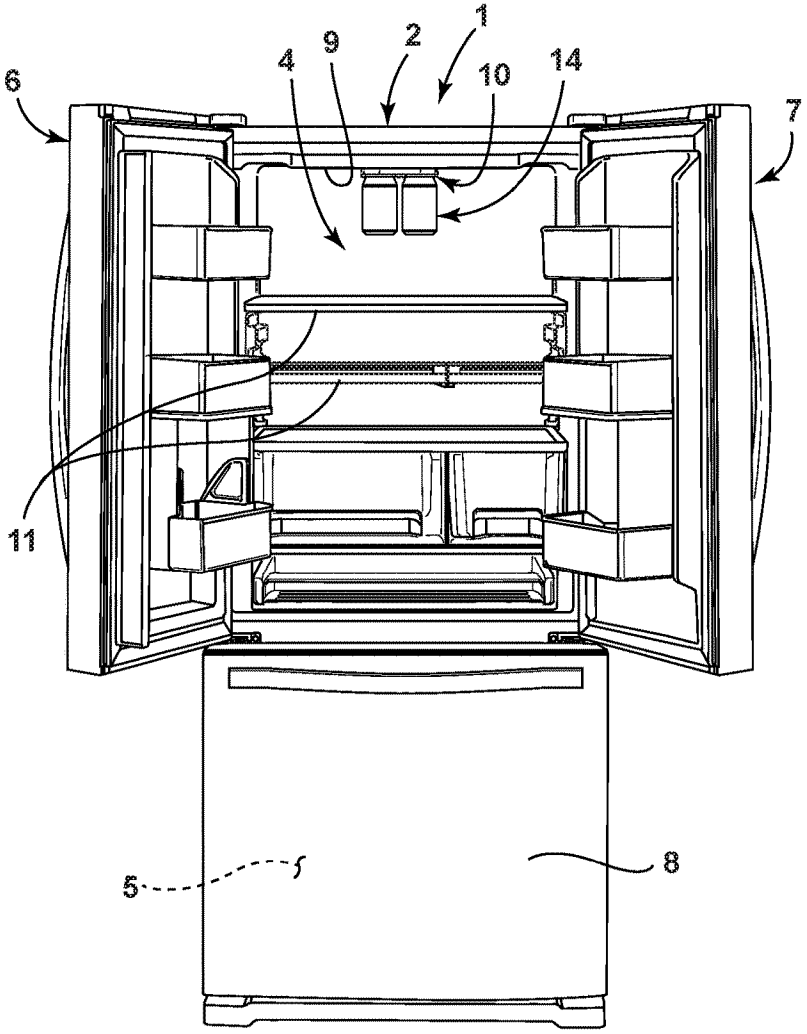
FIG. 3 is a front elevational view of the refrigerator and beverage holder of FIG. 1 showing cans received in the beverage holder.

Referring now to FIG. 3, cans 14 are shown mounted to the beverage holder 10 within the refrigerator compartment 4. The cans 14 are shown as being suspended from the beverage holder 10, as further described below.

Figure 4:
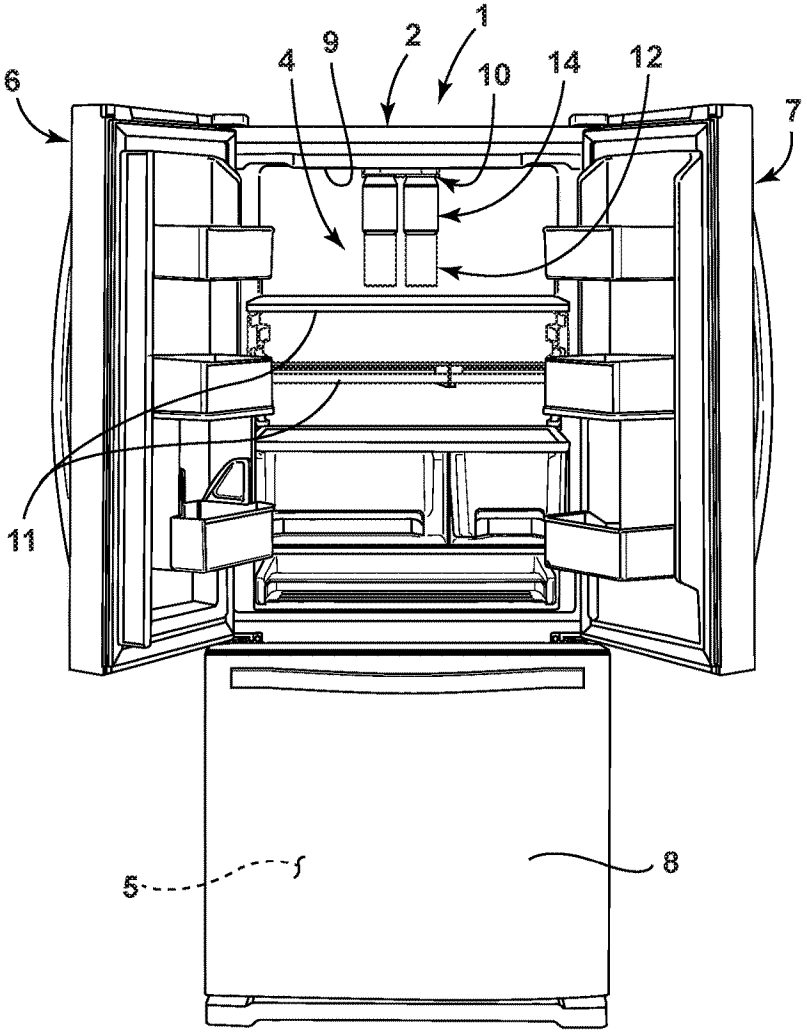
FIG. 4 is a front elevational view of the refrigerator and beverage holder of FIG. 1 showing bottles and cans received in the beverage holder.

Referring now to FIG. 4, bottles 12 and cans 14 are shown mounted to the beverage holder 10 within the refrigerator compartment 4. Thus, the beverage holder 10 is configured to hold bottles and cans simultaneously in multiple rows in an aligned manner, as further described below.

Figure 5:
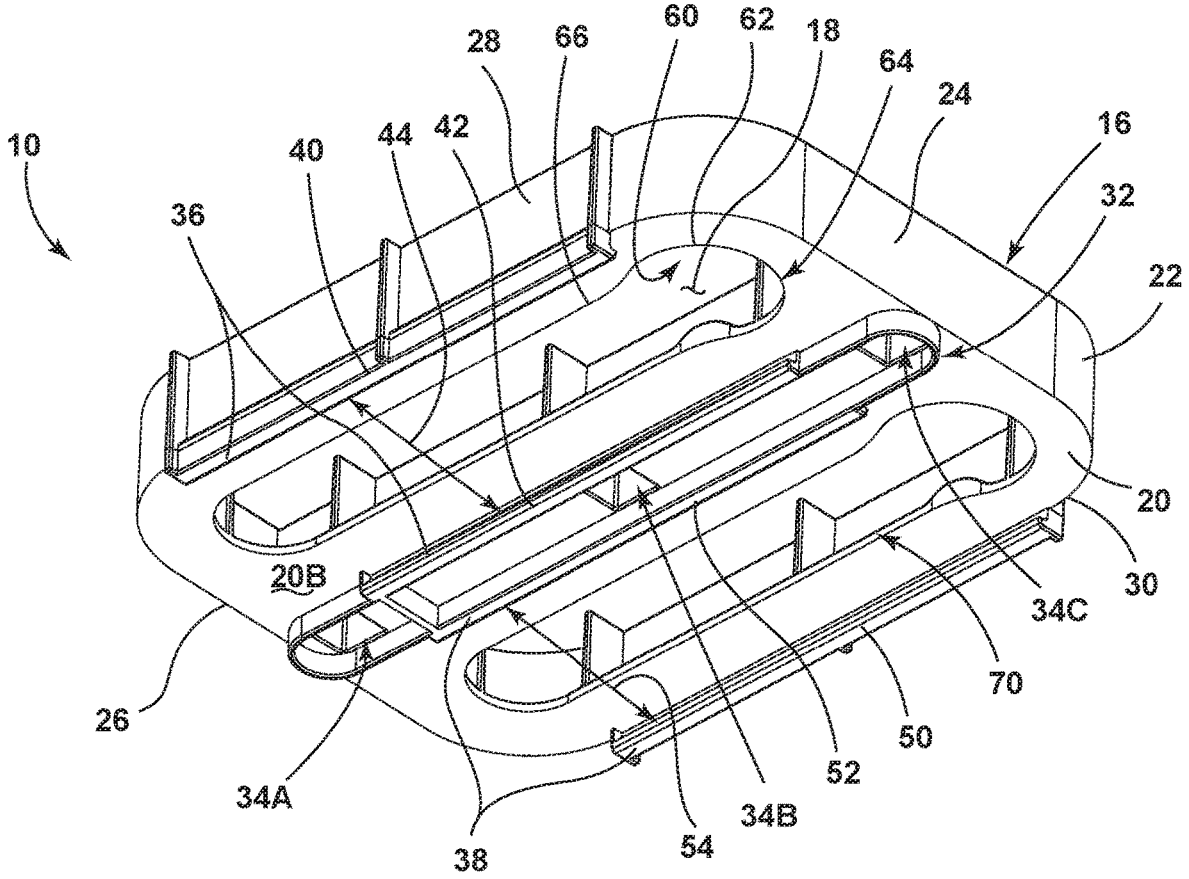
FIG. 5 is a bottom perspective view of a beverage holder according to an embodiment.

Referring now to FIG. 5, the beverage holder 10 is shown as removed from the refrigerator. As shown in FIG. 5, the beverage holder 10 includes a body portion 16 having an interior cavity 18 that is defined by a platform 20 and a sidewall 22 that upwardly extends from an upper side 20A (FIG. 6) of the platform 20. As shown in FIG. 5, the sidewall 22 includes front and rear portions 24, 26 and side portions 28, 30 that interconnect the front and rear portions 24, 26 to fully surround the platform 20. A structural reinforcement member 32 extends downwardly from the underside 20B of the platform 20 and is centrally disposed along the platform 20. The structural reinforcement member 32 includes inset portions 34A, 34B, 34C that are spaced along the structural reinforcement member 32. The inset portions 34A, 34B, 34C define mounting features configured to receive fasteners to mount the beverage holder 10 to a surface of a refrigerator, as further described below.

As further shown in FIG. 5, the beverage holder 10 includes a first set of rails 36 and a second set of rails 38. The first set of rails 36 includes first and second rails 40, 42 that are spaced-apart from one another a distance 44 that defines a receiving channel therebetween. The distance 44 between the first and second rails 40, 42 is specifically configured to receive and retain a lip of a lid of a can, as further described below with reference to FIGS. 12B and 12D. Similarly, the second set of rails 38 includes first and second rails 50, 52 that are spaced-apart from one another a distance 54 that defines a receiving channel therebetween. The first and second rails 40, 42 of the first set of rails 36, and the first and second rails 50, 52 of the second set of rails 38 are contemplated to be identically configured, such that the description of the first and second rails 40, 42 of the first set of rails 36 is meant to also describe the first and second rails 50, 52 of the second set of rails 38.

As further shown in FIG. 5, a slot 60 is shown disposed between the first and second rails 40, 42 of the first set of rails 36, such that the first rail 40 is disposed on a first or outer side of the slot 60, and the second rail 42 is disposed on a second or inner side of the slot 60. In the embodiment shown in FIG. 5, the slot 60 is centrally positioned between the first and second rails 40, 42 of the first set of rails 36 and is disposed through the platform 20, such that the slot 60 opens into the interior cavity 18 of the body portion 16 of the beverage holder 10. The slot 60 includes a perimeter edge 62 that defines a receiving aperture 64 and an elongated portion 66. The slot 60 is configured to receive and support bottles, such as bottles 12 shown in FIG. 2, along the elongated portion 66 thereof. As further shown in FIG. 5, a second slot 70 is shown disposed between the first and second rails 50, 52 of the second set of rails 38 and is contemplated to be identical in configuration to the slot 60 disposed between the first and second rails 40, 42 of the first set of rails 36, such that the description of one further describes the other. While the beverage holder 10 shown in FIG. 5 includes two sets of rails 36, 38 and two slots 60, 70 centrally disposed therein, respectively, it is contemplated that any number of slots and rails can be integrated into the beverage holder 10 without departing from the spirit of the concept. In the embodiment of FIG. 5, the first and second rails 40, 42 of the first set of rails 36 and the first and second rails 50, 52 of the second set of rails are disposed outwardly of first and second opposed sides of the slots 60, 70, respectively.

Figure 6:
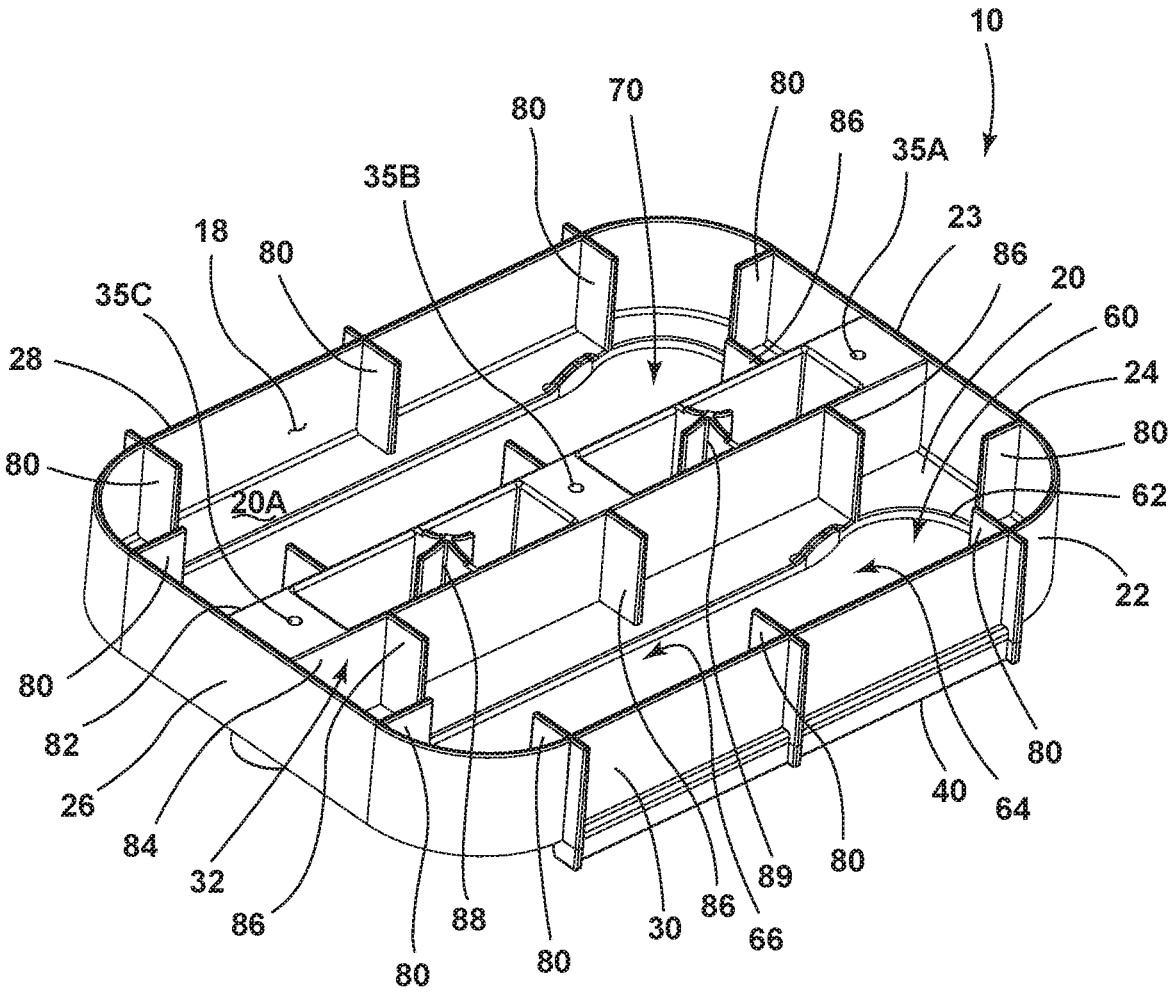
FIG. 6 is a top perspective view of the beverage holder of FIG. 5.

Referring now to FIG. 6, the beverage holder 10 is shown from a top perspective view, such that the interior cavity 18 can be seen. The sidewall 22 includes an upper edge 23 that is disposed therearound and configured to abut the top surface 9 of the refrigerator compartment 4 (FIG. 1) to close off the interior cavity 18 of the beverage holder 10. Within the interior cavity 18, the beverage holder 10 includes a plurality of reinforcement members 80 that interconnect an upper side 20A of the platform 20 with the sidewall 22. In FIG. 6, the structural reinforcement member 32 includes sidewalls 82, 84 extend upwardly from the upper side 20A of the platform 20 and that interconnect the front and rear portions 24, 26 of the sidewall 22. Reinforcement members 86 are positioned around the structural reinforcement member 32 and interconnect the sidewalls 82, 84 with the upper side 20A of the platform 20. The structural reinforcement member 32 further includes mounting apertures 35A, 35B, 35C disposed between the sidewalls 82, 84 that align with the inset portions 34A, 34B, 34C shown in FIG. 5. In use, the mounting apertures 35A, 35B, 35C are configured to receive fasteners for securely mounting the beverage holder 10 to a surface of a refrigerator. Locating features 88, 89 are also disposed along the structural reinforcement member 32 between the sidewalls 82, 84 and are used to locate the beverage holder 10 to a surface of a refrigerator in assembly. The beverage holder 10, as shown and described above with reference to FIGS. 5 and 6, is contemplated to be a unitary or monolithic structure that is created using a polymeric material (such as ABS) in a forming process (such as injection molding).

Figure 7:
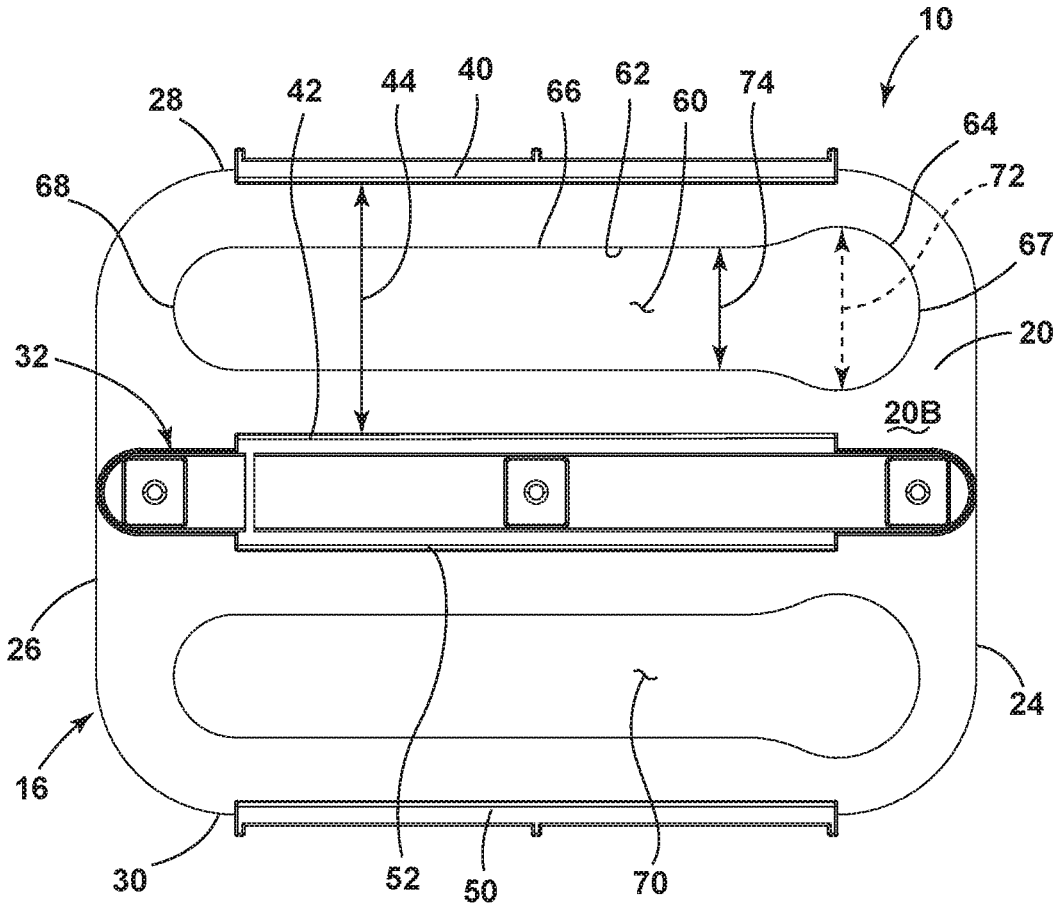
FIG. 7 is a bottom plan view of the beverage holder of FIG. 5.

Referring now to FIG. 7, the slot 60 will now be described. This description will also accurately describe slot 70. In FIG. 7, the slot 60 is shown disposed through the platform 20 and has the receiving aperture 64 disposed on a front portion 67 of the slot 60. The elongate portion 66 extends away from the receiving aperture 64 and terminates at a rear end 68 of the slot 60. The receiving aperture 64 is a round aperture that opens upwardly into the interior cavity 18 of the body portion 16 of the beverage holder 10. The receiving aperture 64 further opens laterally into the elongate portion 66 of the slot 60. The receiving aperture 64 includes a diameter 72 that is specifically sized to accommodate an upper portion of a bottleneck, as further described below. The elongate portion 66 of the slot 60 includes a width 74 that is narrower or less than the diameter 72 of the receiving aperture 64. In this way, the elongate portion 66 of the slot 60 is configured to retain an upper portion of a bottleneck once said upper portion has been introduced into the interior cavity 18 of the beverage holder 10 through the receiving aperture 64 as best shown in FIG. 12C. This bottle retaining feature of the beverage holder 10 is further described below with specific reference to FIG. 9. Thus, the receiving aperture 64 defines an enlarged first portion of the slot 60, while the elongate portion 66 defines a narrowed second portion of the slot 60 that is narrower than the enlarged first portion. As further shown in FIG. 7, the slot 60 is centrally disposed between the first and second rails 40, 42. Thus, when a can is suspended from the first and second rails 40, 42 and a bottle is suspended at the elongate portion 66 of the slot 60, the bottle and can will be aligned with one another, as specifically shown in FIG. 12A.

Figure 8:
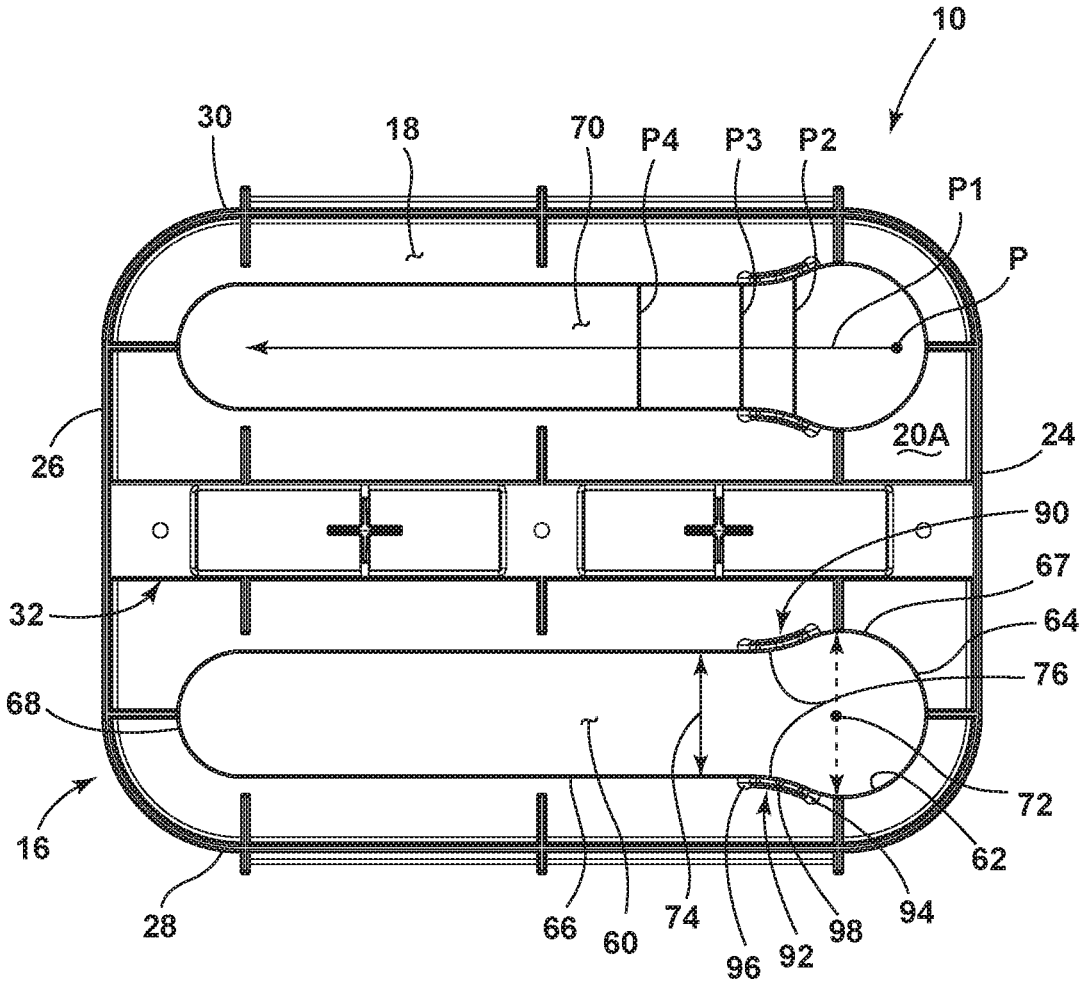
FIG. 8 is a top plan view of the beverage holder of FIG. 5.

Referring now to FIG. 8, the beverage holder 10 is shown from a top plan view, wherein the slots 60, 70 are shown opening into the interior cavity 18 of the body portion 16 of the beverage holder 10. With specific reference to slot 60, the receiving aperture 64 is shown opening into the elongate portion 66 of the slot 60 at transition areas 76 disposed along the edge 62 of the slot 60. At the transition areas 76, engagement features 90, 92 are shown extending upwardly from the upper side 20A of the platform 20. With specific reference to engagement feature 92, the engagement feature 92 includes a ramped first portion 94 that is angled towards the receiving aperture 64 of the slot 60. The engagement feature 92 further includes a ramped second portion 96 that is positioned adjacent to the ramped first portion 94. The ramped second portion 96 is angled towards the elongate portion 66 of the slot 60. In use, the engagement features 90, 92 are configured to retain the upper portions of bottlenecks within the elongate portion 66 of the slot 60 by providing an obstacle at the transition area 76 between the receiving aperture 64 and of the elongate portion 66 of the slot 60.

As further shown in FIG. 8, a path P is shown with respect to slot 70 that tracks the movement of an upper portion of a bottleneck through the slot 70. Specifically, at location P1, the upper portion of the bottleneck is introduced into the slot 70 at the receiving aperture thereof. At location P2, the bottleneck engages the ramped first portions 94 of the engagement features 90, 92 which guides the upper portion of the bottleneck towards the ramped second portion 96 of the engagement features 90, 92. Thus, the ramped first portion 94 of the engagement features 90, 92 provides an inclined surface that leads towards a centrally positioned middle portion 98 of the engagement features 90, 92 which forms a peak of the engagement features 90, 92. From the centrally positioned middle portion 98 of the engagement features 90, 92 the upper portion of the bottleneck is introduced to the ramped second portion 96 of the engagement features 90, 92 at location P3 along path P that provides a declining surface towards the elongate portion 66 of the slot 70. At location P4 of the path P wherein portions of the upper portion of the bottleneck are configured to abut the upper side 20A of the platform 20 retain the bottle in the slot 60.

Figure 9:
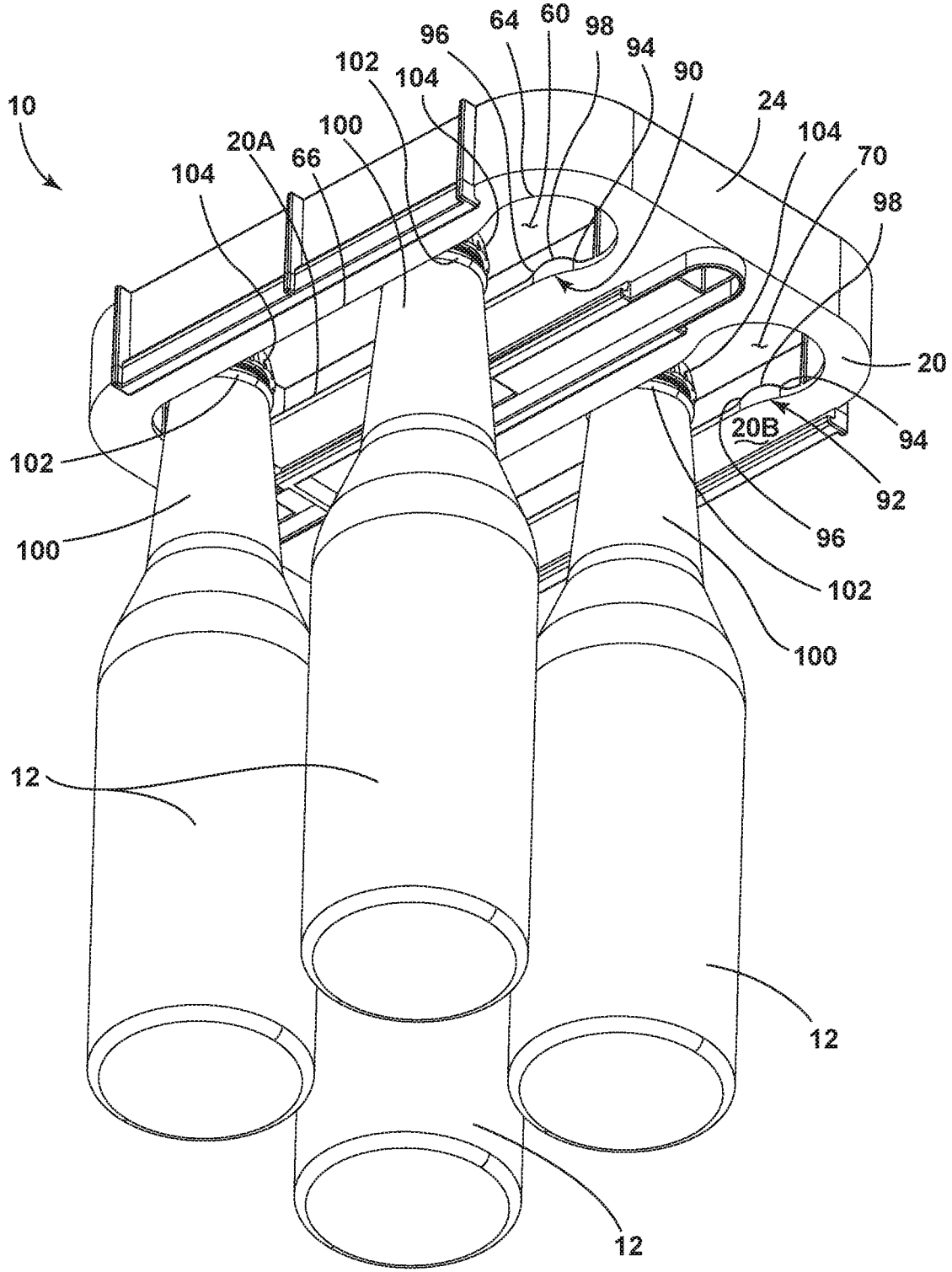
FIG. 9 is a bottom perspective view of the beverage holder of FIG. 5 with 4 bottles received therein.
Figure 10:
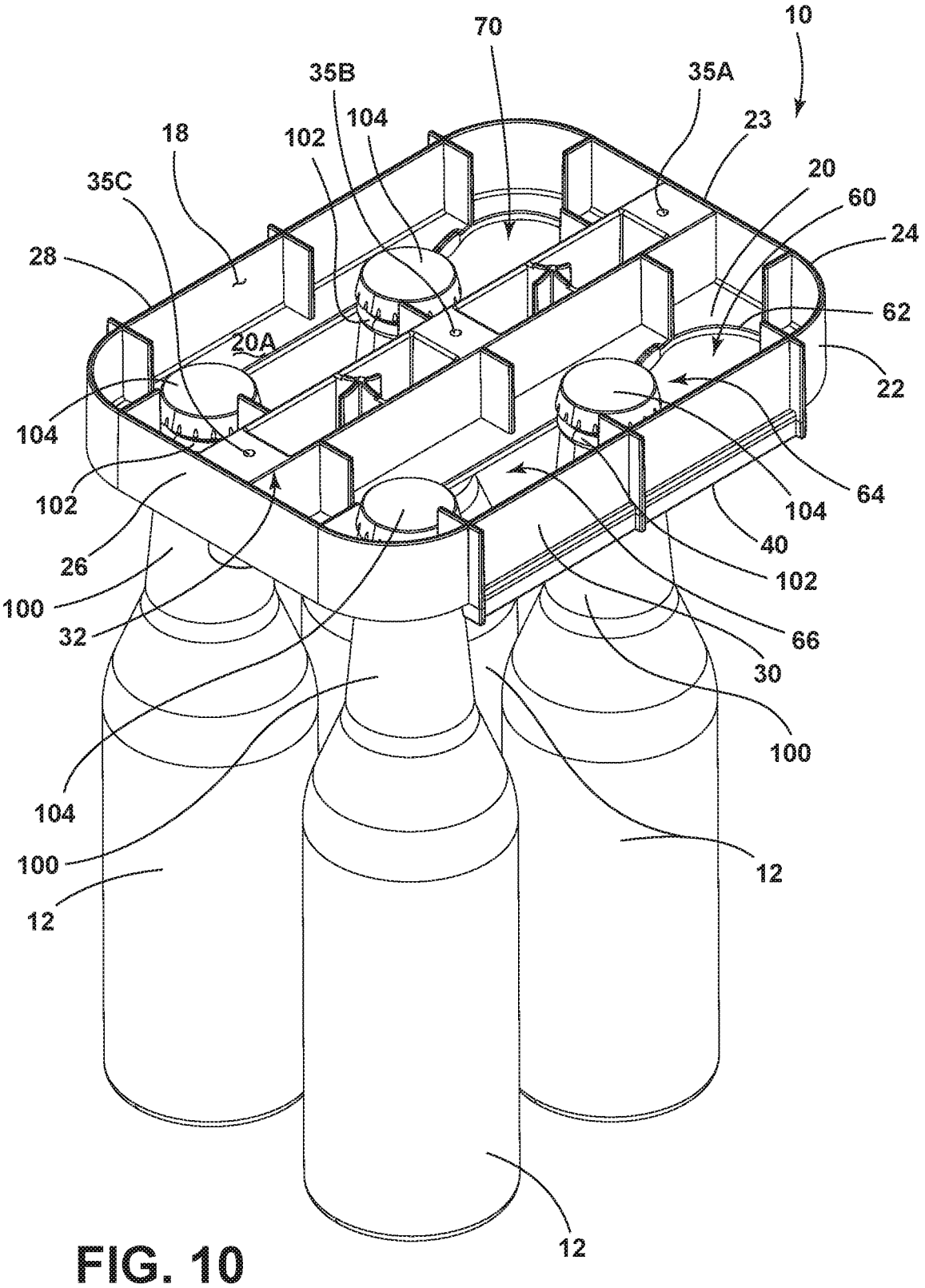
FIG. 10 is a top perspective view of the beverage holder of FIG. 9.

Referring now to FIG. 9, four bottles 12 are shown received within the beverage holder 10 at slots 60, 70. Each bottle 12 includes a bottleneck 100 having a lip 102 disposed at an upper portion thereof. Each bottle 12 further includes a bottle cap 104. The bottles 12 shown in FIG. 9 are contemplated to be generic 12 oz bottles which included the bottleneck and lip configuration shown in FIG. 9. The lip 102 of each bottle 12 is fully disposed around the upper portion of the bottleneck 100 and extends outwardly therefrom. The lip 102 of each bottle 12 is configured to be received through the receiving aperture 64 of the slot 60 and then guided over the engagement features 90, 92 towards the elongate portion 66 of the slot 60. While the lip 102 of each bottle 12 is configured to be received through the receiving aperture 64 of the slot 60, the lip 102 of each bottle 12 extends outwardly from the bottleneck 100 to an extent that the lip 102 of each bottle 12 is larger than the width 74 of the slot 60 at the elongate portion 66. In this way, the underside of the lips 102 of the bottles 12 abuts the upper side 20A of the platform 20 retain the bottles 12 in the respective slots 60, 70. When a user wishes to retrieve a bottle 12 from the beverage holder 10, the bottles 12 can be urged from the elongate portion 66 of the slot 60 over the engagement features 90, 92 to the receiving aperture 64 of the slot 60, wherein the lip 102 of the upper portion of the bottleneck 100 includes a diameter that is less than the diameter 72 of the receiving aperture 64, such that the bottle cap 104 and the lip 102 of the upper portion of the bottleneck 100 can pass through the receiving aperture 64 of the slot 60 to enter the interior cavity 18 of the beverage holder 10. In FIG. 10, the bottles 12 are shown as suspended from the along the edges 62 of the slots 60, 70 by the lips 102 of the bottles 12. As such, the bottles 12 abut the upper side 20A of the platform when suspended in the slots 60, 70. As further shown in FIG. 10, the lips 102 of the bottles 12 are positioned at the elongate portion 66 of the slots 60, 70, such that the bottles 12 have passed over the engagement members 90, 92 positioned between the elongate portions 66 and receiving apertures 64 of the slots 60, 70.

Figure 11:
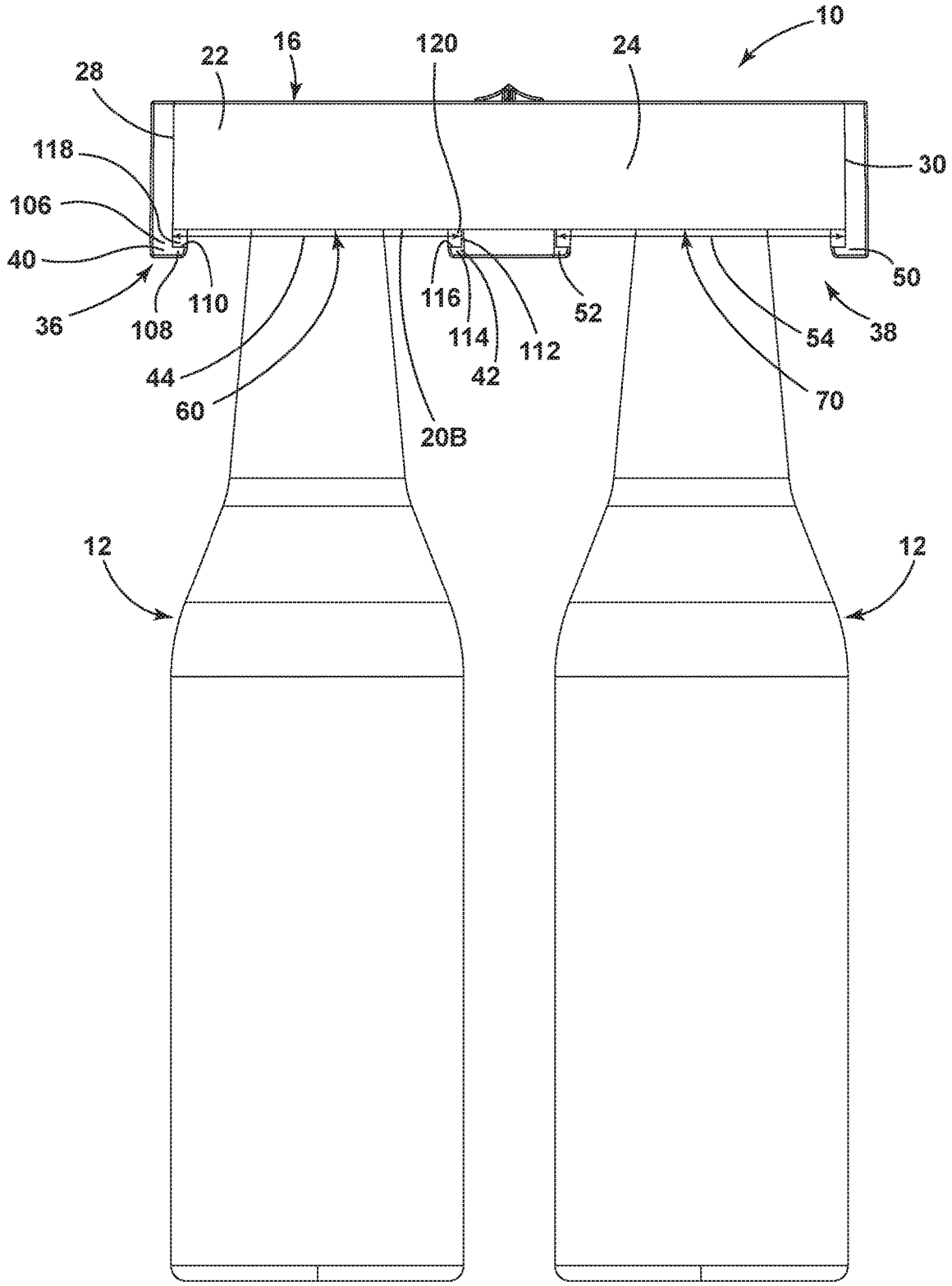
FIG. 11 is a fragmentary front elevational view of the beverage holder of FIG. 9.

Referring now to FIG. 11, the first and second sets of rails 36, 38 are shown from a front elevation view of the beverage holder 10. The first and second sets of rails 36, 38 each include a first rail 40, 50 and a second rail 42, 52, respectively, that are spaced-apart to define receiving channels 44, 54, respectively, therebetween. The first and second rails 40, 42 and 50, 52 are shown in FIG. 11 as being substantially identical to one another, such that the description of the first and second rails 40, 42 of the first set of rails 36 will also describe the first and second rails 50, 52 of the second set of rails 38, as indicated in FIG. 12B. In FIG. 11, the first rail 40 is shown as an L-shaped rail having a first portion 106 downwardly extending from the side portion 28 of the body portion 16 of the beverage holder 10. The first portion 106 positions the first rail 40 below the underside 20B of the platform 20. The first rail 40 further includes a second portion 108 disposed orthogonally to the first portion 106 and extending inwardly therefrom. The inwardly extending second portion 108 of the first rail 40 includes an upper surface 110. Similarly, the second rail 42 is shown as an L-shaped rail having a first portion 112 downwardly extending from structural reinforcement member 32 of the body portion 16 of the beverage holder 10. The first portion 112 of the second rail 42 also positions the second rail 42 below the underside 20B of the platform 20. Like the first rail 40, the second rail 42 further includes a second portion 114 disposed orthogonally to the first portion 112 and extending inwardly therefrom. The inwardly extending second portion 114 of the second rail 42 includes an upper surface 116. Thus, the second portions 108, 114 of the first and second rails 40, 42 inwardly extend towards one another to define a T-shaped channel for the receiving channel 44. The first and second rails 40, 42 further include inwardly extending end walls 118, 120, respectively, that close the receiving channel 44. Slot 60 is disposed between the first and second rails 40, 42 and includes a bottle 12 suspended therefrom. Thus, the second portions 108, 114 of the first and second rails 40, 42, respectively, inwardly extend not only towards one another, but towards the slot 60 of the beverage holder 10 as well. Thus, the first and second rails 40, 42 are opposed first and second L-shaped rails. In use, the first and second rails 40, 42 downwardly extending from the platform 20 and are configured to support a can in the receiving channel 44 defined therebetween, as best shown in FIGS. 12B and 12D.

Figure 12A:
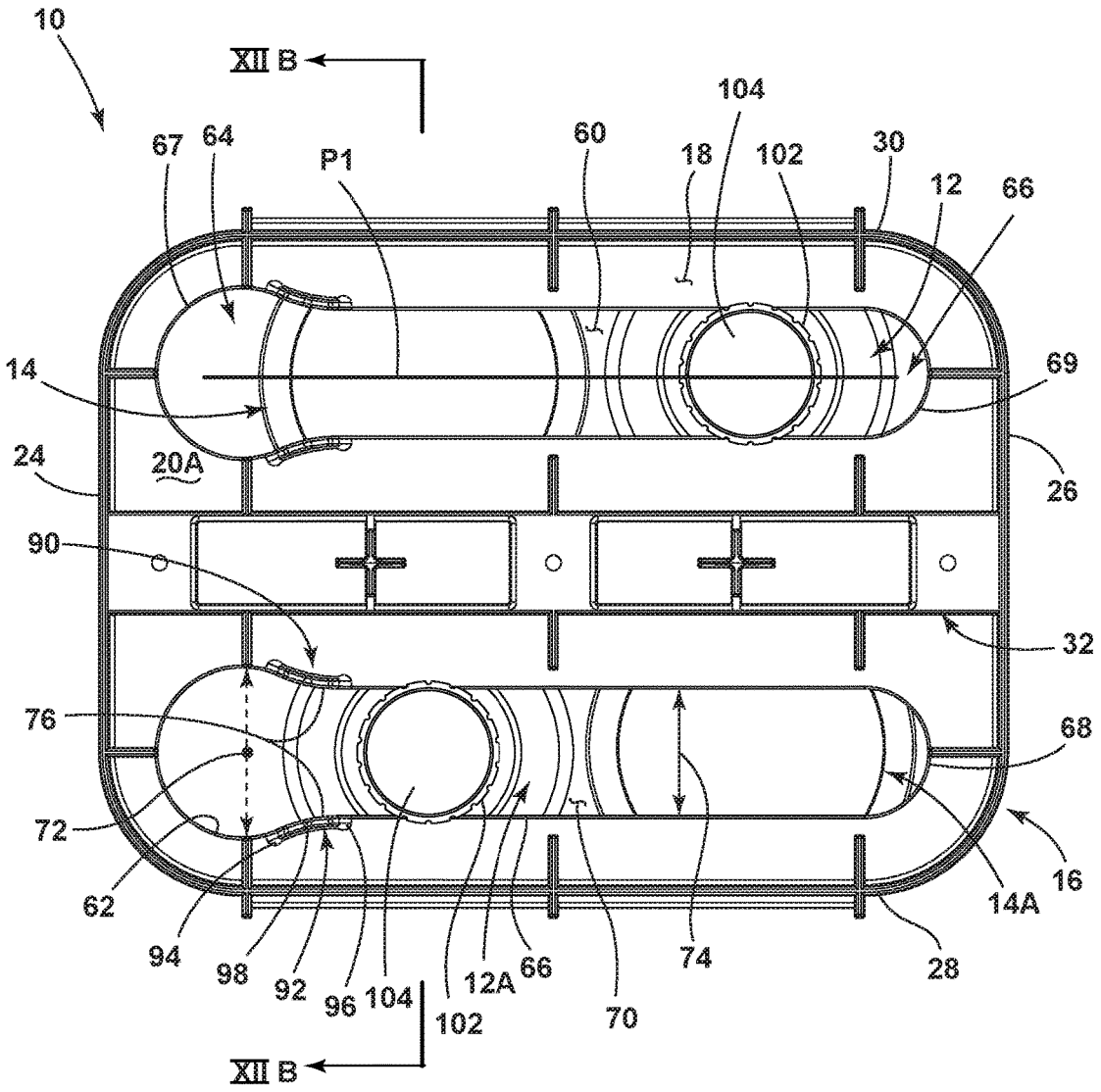
FIG. 12A is a top plan view of the beverage holder of FIG. 5 with two cans and 2 bottles received therein.
Figure 12B:
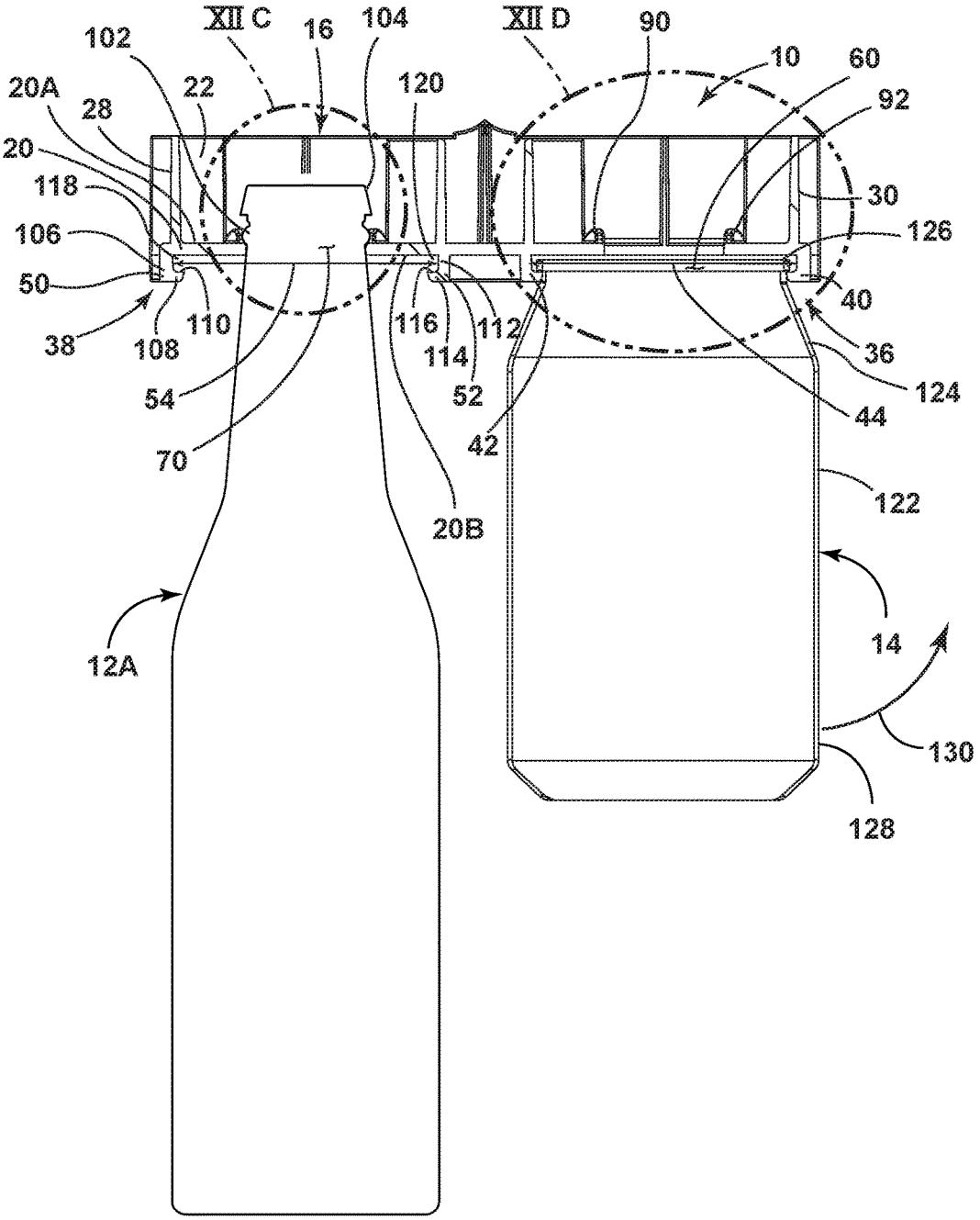
FIG. 12B is a cross sectional view of the beverage holder of FIG. 12A along line XIIB of FIG. 12A.
Figure 12C:
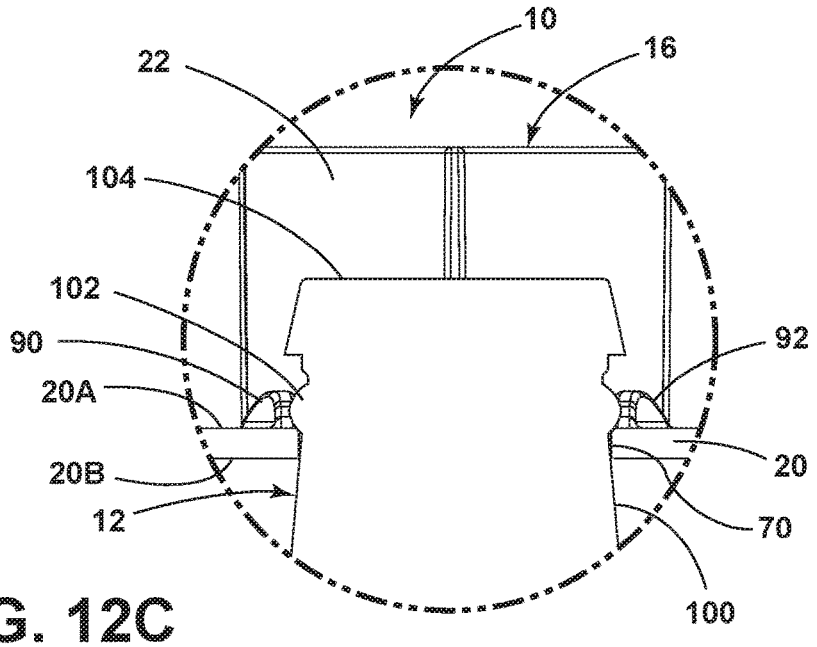
FIG. 12C is a close up view of FIG. 12B taken at location XIIC.
Figure 12D:
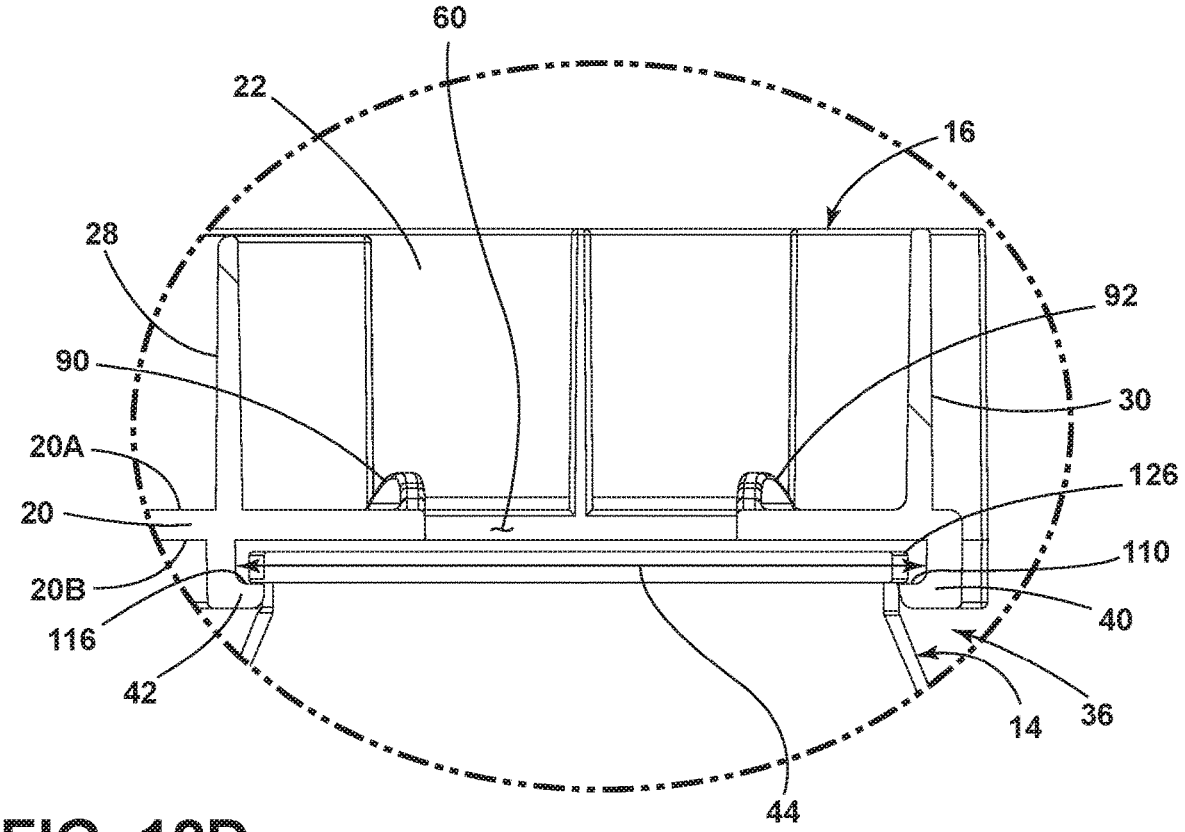
FIG. 12D is a close up view of FIG. 12B taken at location XIID.

Referring now to FIG. 12A, the beverage holder 10 is shown from a top plan view supporting a first can 14 in the receiving channel 44 defined between the first and second rails 40, 42, and a first bottle 12 is shown supported near a closed rear portion 69 of the elongate portion 66 of the slot 60. The first can 14 and the first bottle 12 are aligned with one another along a common vertical plane P1 that is centered between the rails 40, 42 and the slot 60 of the beverage holder 10. Similarly, on an opposite side of the beverage holder 10, a second bottle 12A is shown supported in a front part of the elongate portion 66 of the slot 70, and a second can 14A is shown supported in the receiving channel 54 defined between the first and second rails 50, 52. The second can 14A and the second bottle 12A are aligned with one another along the beverage holder 10.

With reference to the cross sectional view of FIG. 12B, the first can 14 and the second bottle 12A are shown disposed within and supported by the beverage holder 10. With specific reference to FIG. 12C, the outwardly extending lip 102 of the bottle 12A is shown extending over and abutting the upper side 20A of the platform 20, such that the bottle 12A is suspended from the beverage holder 10 with an upper portion of the bottleneck 100 received in slot 60. With specific reference to FIGS. 12B and 12D, the first can 14 is contemplated to be a standard 12 oz can that includes a body portion 122 having an upper tapered portion 124. An outwardly extending lid 126 is disposed over the upper tapered portion 124. As specifically shown in FIG. 12D, the underside of the outwardly extending lid 126 extends over and abuts the upper surfaces 110, 116 of the first and second rails 40, 42 within the receiving channel 44 below the platform 20 of the beverage holder 10.

The beverage holder 10 is configured such that the cans 14 can enter at the open ends of the receiving channels 44, 54 and slide along the respective rails 40, 42 and 50, 52 of the receiving channels 44, 54. Specifically, a can, such as the first can 14 shown in FIGS. 12B and 12D, can enter the open front portion of the receiving channel 44 and slide towards the end walls 118, 120 (FIG. 11) of the first and second rails 40, 42, respectively. At any position along the receiving channel 44, the can 14 can be removed from the first and second rails 40, 42 by rotating a lower portion 128 of the body portion 122 of the can 14 outward in the direction as indicated by arrow 130. Thus, the first and second rails 40, 42 are configured to partially flex to release the can 14 in a snapfit disengagement from the receiving channel 44. In this way, a can, such as second can 14A can be rotated and removed from the rails 50, 52 even when a bottle, such as second bottle 12A is positioned in front of the can 14A along the beverage holder 10.

Bottles 12 that are supported within the beverage holder 10 are contemplated to be removed from the beverage holder 10 only when the upper lip 102 of the bottle 12 is positioned above the receiving aperture 64 of the associated slot 60 or 70. As stored within the slots 60, 70 a bottle 12 can freely slide along the elongate portions 66 of the slots 60, 70 unless another can or bottle is stored in the beverage holder 10 along such a sliding path.

Figure 12E:
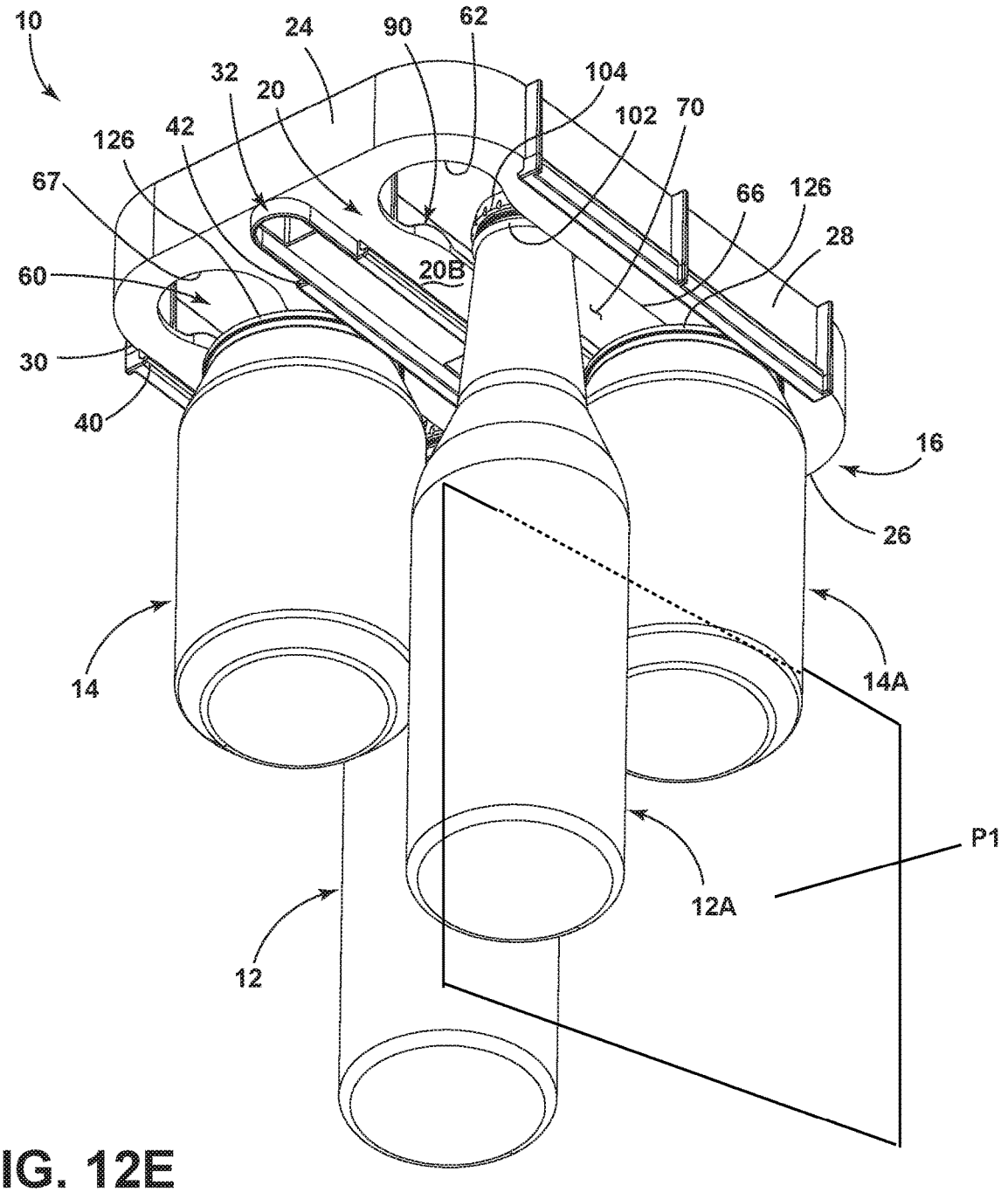
FIG. 12E is a bottom perspective view of the beverage holder of FIG. 12A.

Referring now to FIG. 12E, the beverage holder 10 of FIG. 12A is shown from a bottom perspective view. As shown in FIG. 12E, the first can 14 and first bottle 12 are aligned with one another with the first can 14 suspended from rails 40, 42 and the first bottle 12 suspended from slot 60. Similarly, the second can 14A and the second bottle 12A are aligned with one another with the second can 14A suspended from rails 50, 52 and the second bottle 12A suspended from slot 70. Thus, the bottles and cans are aligned and centered along the slots 60, 70, and also centered along the rails 40, 42 and 50, 52. As such, bottles and cans that are suspended in associated slot and rails combinations, are aligned in a common vertical plane, such as second bottle 12A and second can 14A aligned within the common plane P1.

Figure 13:
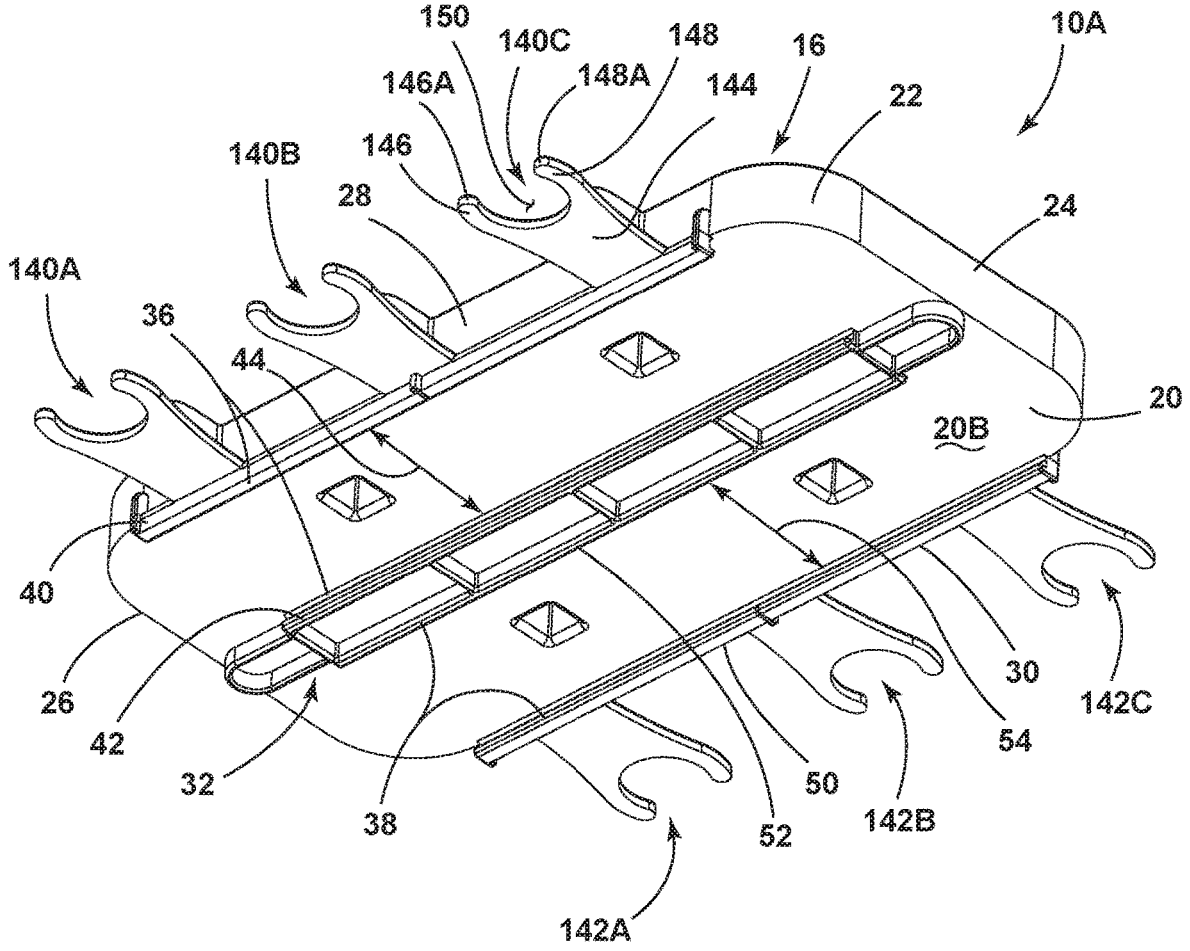
FIG. 13 is a bottom perspective view of a beverage holder according to another embodiment.
Figure 15:
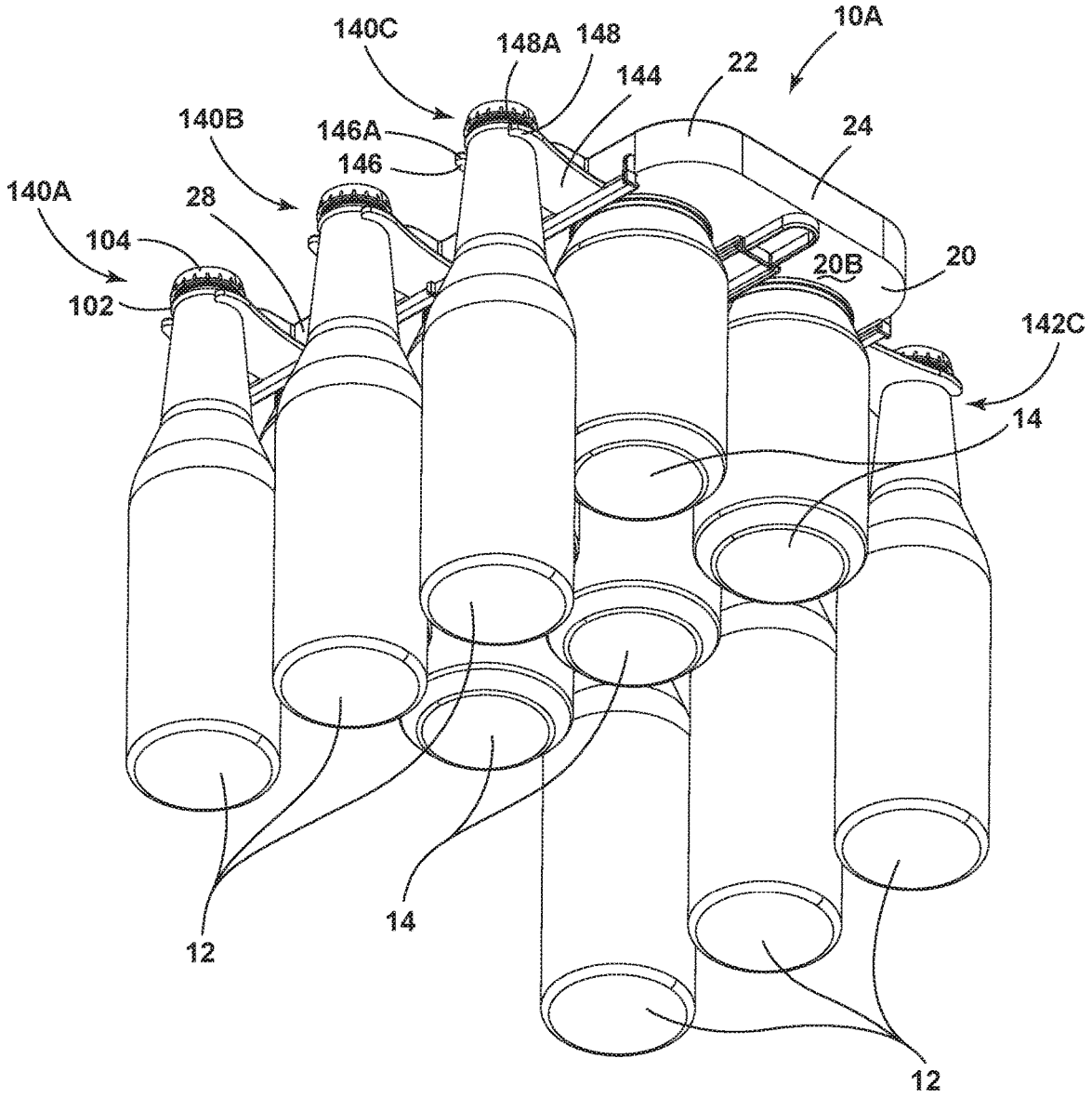
FIG. 15 is a bottom perspective view of the beverage holder of FIG. 13 having six cans and six bottles received therein.

Referring now to FIG. 13, another embodiment of a beverage holder 10A is shown which includes similar features associated with the beverage holder 10 described above. Similar features shared between the beverage holder 10 and the embodiment of the beverage holder 10A shown in FIG. 13 are identified by reference numerals used in the description of the beverage holder 10. Like the beverage holder 10, the beverage holder 10A includes a first set of rails 36 and a second set of rails 38. The first set of rails 36 includes first and second rails 40, 42 that are spaced-apart from one another to define a receiving channel 44 therebetween, and the second set of rails 38 includes first and second rails 50, 52 that are spaced-apart from one another to define a receiving channel 54 therebetween. Unlike the beverage holder 10, the beverage holder 10A does not include slots disposed through the platform 20. Instead, the beverage holder 10 a includes outwardly extending clip members 140A-140C and 142A-142C extending outwardly from the side portions 28, 30, respectively, of the body portion 16 of the beverage holder 10A. Each of the clip members 140A-140C and 142A-142C are configured to hold bottles and include a number of features in common as exemplified by clip member 140C. With specific reference to clip member 140C, a neck portion 144 outwardly extends from the side portion 28 of the body portion 16 of the beverage holder 10A. The neck portion 144 of the clip member 140C culminates in first and second arms 146, 148 which are spaced-apart from one another to define a receiving area 150 therebetween. In use, the first and second arms are configured to partially flex and include rounded outermost tip portions 146A, 148A that help to introduce an upper portion of a bottleneck into the receiving area 150 of the clip member 140C. Thus, the receiving channels 44 and 54 of the beverage holder 10A can be used to receive cans 14, while the clip members 140A-140C and 142A-142C can be used to releasably receive bottles 12 as shown in FIG. 15.

Figure 14:
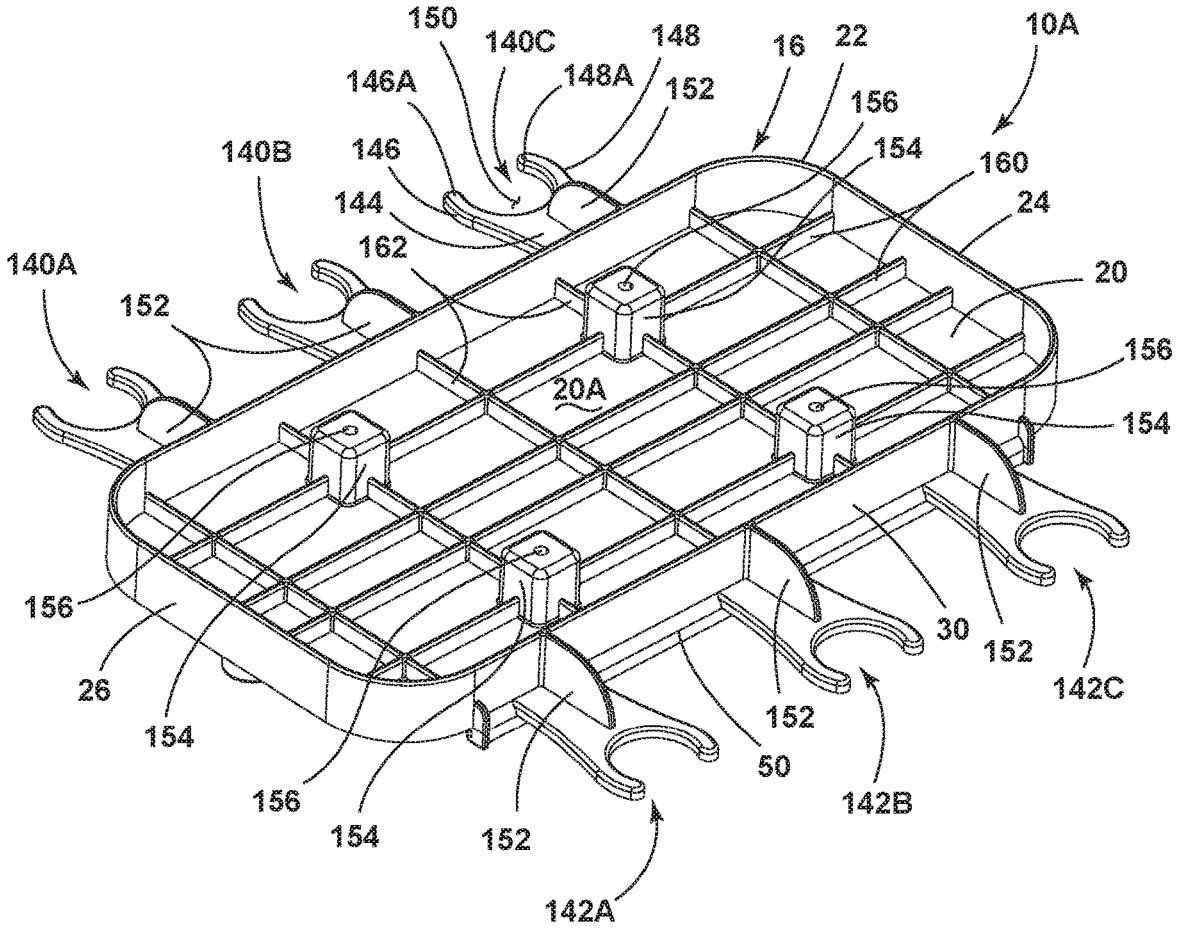
FIG. 14 is a top perspective view of the beverage holder of FIG. 13.

Referring now to FIG. 14, reinforcement tabs 152 are shown disposed on the clip members 140A-140C and 142A-142C and interconnect the clip members 140A-140C and 142A-142C with the side portion 28 and the side portion 30 of the body portion 16 of the beverage holder 10A to provide sufficient rigidity in order to support a bottle in an outwardly extended position within the clip members 140A-140C and 142A-142C. As further shown in FIG. 14, mounting bosses 154 are shown extending upwardly from the upper side 20A of the platform 20 and include mounting apertures 156 which are used to receive fasteners to mount the beverage holder 10A to a suitable surface within a refrigerator. Reinforcement ribs 160, 162 upwardly extend from the upper side 20A of the platform 20 and are used to rigidify the body portion 16 of the beverage holder 10A for supporting a full load of beverages, as best shown in FIG. 15.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A beverage holder, comprising:

a body portion having a platform with an upper surface;

a sidewall upwardly extending from the upper surface of the platform and having a front portion, a rear portion and side portions that interconnect the front and rear portions to surround the platform and define an interior cavity positioned above the platform;

a slot disposed through the platform and opening into the interior cavity, wherein the slot includes an enlarged first portion and a narrowed second portion, wherein the narrowed second portion includes a width that is narrower than the enlarged first portion;

a first rail having first and second portions, wherein the first portion of the first rail downwardly extends below the platform of the body portion; and a second rail having first and second portions, wherein the first portion of the second rail downwardly extends below the platform of the body portion, and further wherein the second portions of the first and second rails inwardly extend towards one another, and further wherein the first and second rails are spaced-apart from one another a distance that is greater than the width of the narrowed second portion of the slot to define a receiving channel therebetween.

2. The beverage holder of claim 1, wherein the slot is disposed between the first and second rails.

3. The beverage holder of claim 1, including:

at least one engagement feature disposed on an edge of the slot and extending upwardly from an upper side of the platform.

4. The beverage holder of claim 3, wherein the at least one engagement feature is positioned at a transition area between the first and second portions of the slot.

5. The beverage holder of claim 4, wherein the at least one engagement feature includes a ramped first portion angled towards the enlarged first portion of the slot, and a ramped second portion positioned adjacent to the ramped first portion and angled towards the narrowed second portion of the slot.

6. A beverage holder, comprising:

a platform having opposed first and second L-shaped rails spaced-apart from one another to define a receiving channel therebetween having a width, wherein the opposed first and second L-shaped rails extend downwardly from the platform, and further wherein the opposed first and second L-shaped rails are configured to suspend a first object therefrom;

a slot disposed through the platform and positioned between the opposed first and second L-shaped rails, wherein the slot is configured to suspend a second object therefrom in alignment with the first object, and further wherein the slot includes a width that is less than the width of the receiving channel; and wherein the opposed first and second L-shaped rails define a first set of rails, and further wherein a second set of rails includes opposed first and second L-shaped rails spaced-apart from one another and extending downwardly from the platform.

7. The beverage holder of claim 6, wherein the slot includes a receiving aperture disposed at a front portion thereof.

8. The beverage holder of claim 7, wherein the receiving aperture of the slot opens into an elongate portion of the slot.

9. The beverage holder of claim 8, wherein the receiving aperture includes a diameter that is larger than the width of the slot.

10. The beverage holder of claim 6, including:

a sidewall extending upwardly from the platform to define an interior cavity between the sidewall and the platform.

11. The beverage holder of claim 10, wherein the slot opens into the interior cavity.

12. The beverage holder of claim 6, including:

a second slot disposed through the platform, wherein the second slot is positioned between the opposed first and second L-shaped rails of the second set of rails.

* * * * *